United States Patent [19]

Edling

[11] Patent Number: 4,617,763

[45] Date of Patent: Oct. 21, 1986

[54] BELT DRIVEN KNIFE SHARPENER

[76] Inventor: Theodore L. Edling, 4333 Willow Rd., Bethel Island, Calif. 94511

[21] Appl. No.: 632,376

[22] Filed: Jul. 19, 1984

[51] Int. Cl.[4] ..... B24B 21/00

[52] U.S. Cl. ..... 51/135 R; 51/140; 51/141; 51/148; 51/285; 51/102

[58] Field of Search ..... 51/74 BS, 80 BS, 81 BS, 51/82 BS, 83 BS, 84 BS, 85 BS, 87 BS, 91 BS, 92 BS, 102, 135 R, 135 BT, 137, 140, 141, 148, 208, 285; 76/82.2, 84, 88

[56] References Cited

U.S. PATENT DOCUMENTS

| | | | |
|---|---|---|---|
| 1,170,898 | 2/1916 | Hancock | 51/285 |
| 2,124,592 | 7/1938 | Schaefer | 51/140 |
| 2,124,593 | 7/1938 | Schaefer | 51/140 |
| 2,461,690 | 2/1949 | Leong | 76/84 X |
| 2,601,749 | 7/1952 | Johnson | 51/140 |
| 2,624,158 | 1/1953 | Hendrickson | 51/135 BT |
| 2,640,303 | 6/1953 | Johnson | 51/135 R |
| 2,706,367 | 4/1955 | MacCarthy | 51/148 |
| 2,780,033 | 2/1957 | Albright | 51/148 X |
| 3,526,061 | 9/1970 | Battocchi | 51/102 |

*Primary Examiner*—Robert P. Olszewski

*Attorney, Agent, or Firm*—Thomas M. Freiburger

[57] ABSTRACT

A knife sharpener includes a pair of grinding belts, each supported on at least two rollers. In an area where a knife is sharpened, support rollers of the two belts are spaced apart by a few inches, each including a resilient rubber sleeve over the roller and immediately under the belt to provide a resilient belt cushioning support where the belt is engaged by the knife. A guide roller is positioned between the two support rollers and belts, closely spaced to each of the belts but out of contact therefrom, with the support roller also including a resilient rubber sleeve. A knife to be sharpened is positioned between the guide roller and one of the grinding belts, perpendicular to the axes of the guide roller and the support roller, and twisted in order to force the cutting edge of the knife against the grinding belt while bracing the non-cutting edge of the knife against the rotatable guide roller, for stability and accuracy in grinding the knife edge. When one side of the knife's cutting edge has been ground, the knife is moved over to the other side of the guide roller for engaging its opposite side against the other grinding belt. Both belts move away from the user.

5 Claims, 5 Drawing Figures

BELT DRIVEN KNIFE SHARPENER

BACKGROUND OF THE INVENTION

The invention relates to knife sharpeners, and more particularly to a grinding belt type knife sharpener of improved accuracy and ease of use.

Knife sharpeners and tool grinders of the grinding belt type, with one grinding belt or two, are well known. For example, see U.S. Pat. Nos. 2,124,592, 2,124,593, 2,789,400, 2,341,068 and 1,076,801. Schaefer U.S. Pat. No. 2,124,592 referenced above is somewhat pertinent to the present invention in that it discloses a pair of grinding belts on adjacent rollers, with the knife or tool engageable between the rollers, and with the rollers at the location of knife sharpening covered by a "tire of rubber" which was said to be yeildable and relatively soft. However, the purpose of the yieldable material on the rollers, as stated in the patent, was only to help drive the two adjacent rollers together by friction, the two rollers and supported belts being pressed together at that location. The Schaefer patent contains no disclosure relating to the function of a rubber sleeve under the belt as a resilient cushion aiding in the sharpening of the knife or tool, and in fact, the rollers and belts of the patent are in an entirely different configuration from that of the present invention, with the knife to be sharpened shown longitudinally parallel to the axes of rotation of the rollers, failing to take advantage of the benefits of the present invention.

No belt type knife sharpener of the prior art has provided for the efficient sharpening and smooth cutting edge resulting from the apparatus of the present invention described below.

SUMMARY OF THE INVENTION

The knife sharpening apparatus of the present invention is easily used and quickly forms a smooth, sharp cutting edge on a knife. In its simplest form, a knife sharpener according to the invention includes a base, at least one grinding belt, and at least two rollers mounted for rotation on the base, with generally parallel axes of rotation, supporting the grinding belt. A suitable form of motor drives one of the rollers. One of the rollers supporting the grinding belt acts as a support roller for knife sharpening, being positioned on the base and so oriented for engagement of the belt at the location of the roller by a knife to be sharpened, with the knife oriented generally perpendicular to the axis of the support roller. A resilient cushioning sleeve (e.g. of rubber) over the support roller, in contact with and supporting the belt, greatly aids the sharpening operation in providing a degree of resiliency cushioning the belt as the knife blade is pressed against it and drawn back. This aids in the forming of a good cutting edge.

In a preferred embodiment of the invention there are two similar grinding belts in opposite locations and in counterrotation to one another, each having its own set of rollers, driven by the same motor. The support rollers of the two belts are spaced apart a short distance, with a guide roller between them, closely adjacent to each support roller but out of contact with the belts. A resilient sleeve covers the guide roller. The knife to be sharpened is inserted into the narrow crevice between the rotatable guide roller and one of the belts, where the knife is twisted about a longitudinal axis to brace its non-cutting edge against the guide roller to force its cutting edge against the grinding belt with its resilient rubber sleeve underneath. The belts rotate away from the user, and the knife is sharpened by pulling it toward the user as its cutting edge is forced against the belt.

When one side of the cutting edge has been ground, the knife is moved to the other side of the guide roller, into the space between the guide roller and the other belt, and the operation is similarly repeated to grind the other side of the knife's cutting edge.

It is therefore among the objects of the invention to improve on prior knife sharpeners by providing a knife sharpening apparatus which is quickly and easily used and which produces a smooth and accurate cutting edge. These and other objects, advantages, features and characteristics of the invention will be apparent from the following description of a preferred embodiment, considered along with the accompanying drawings.

DESCRIPTION OF A PREFERRED EMBODIMENT

Figure 1:
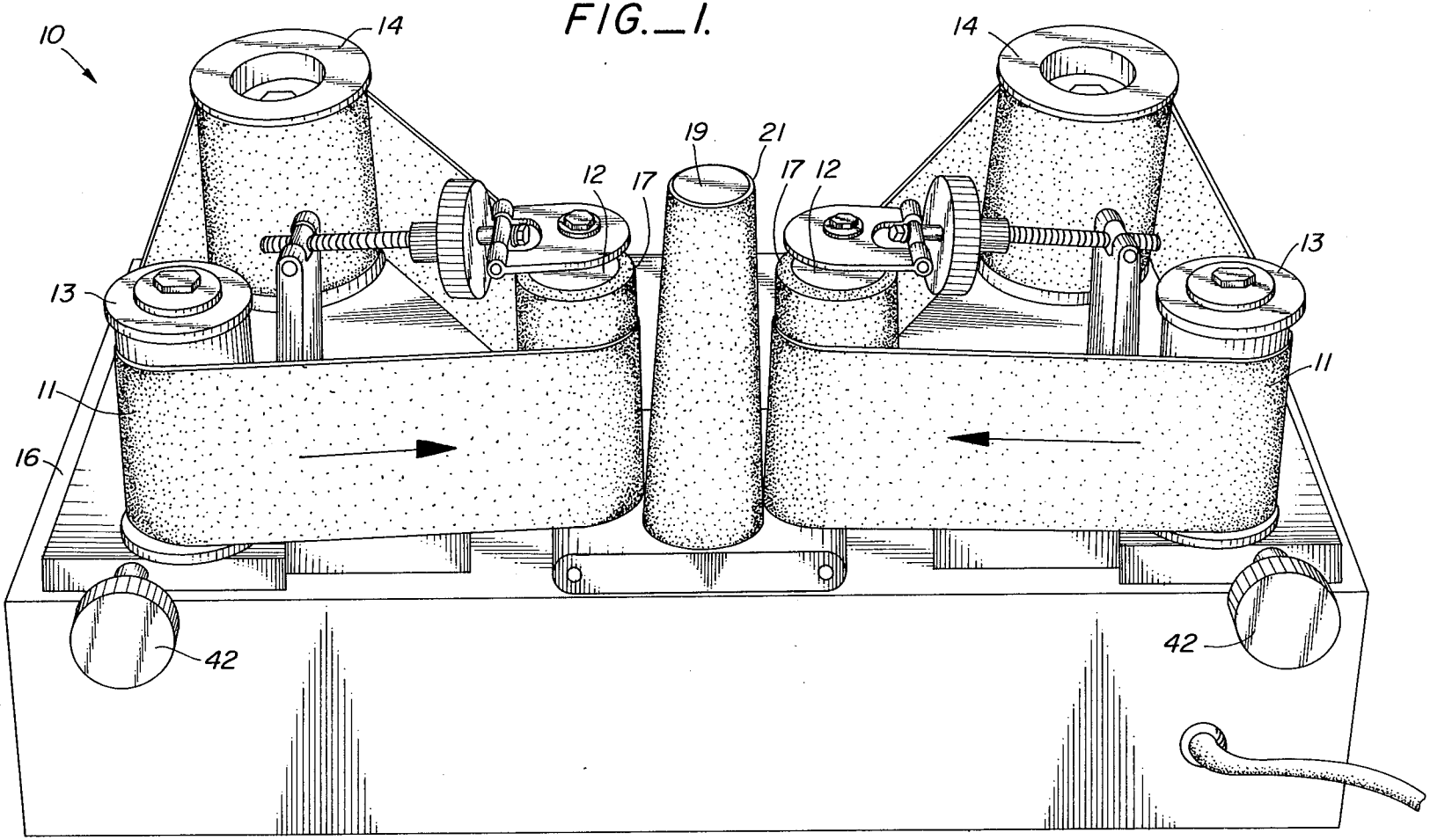
FIG. 1 is a frontal perspective view showing a knife sharpening apparatus according to the present invention.

In the drawings, FIG. 1 shows a knife sharpening apparatus 10 according to the invention, including a pair of similar grinding belts 11, each supported by at least two and preferably three bearing-mounted rollers 12, 13 and 14, the rollers being supported for rotation on a base or frame 16. The two opposed rollers 12, spaced apart a short distance as shown, are support rollers for knife sharpening, and it is an important feature of the invention that each of these rollers is covered with a sleeve 17 of resilient rubber or synthetic material. This provides a cushion under the belt 11 when the belt is engaged by a knife blade 18 as shown in FIG. 2, with the knife longitudinally at right angles to the axes of rotation of the support rollers 12.

The two belts 11, as indicated by arrows in the drawing figures, rotate in opposite directions and away from the user. The sharpening apparatus 10 includes a freely rotatable guide roller 19 positioned between the two support rollers 12, closely adjacent to the two belts 11 at that point but out of contact therefrom. The guide roller 19 may be tapered as shown, and preferably is covered with a resilient sleeve 21 similar to those 17 on the support rollers 12.

Figure 3:
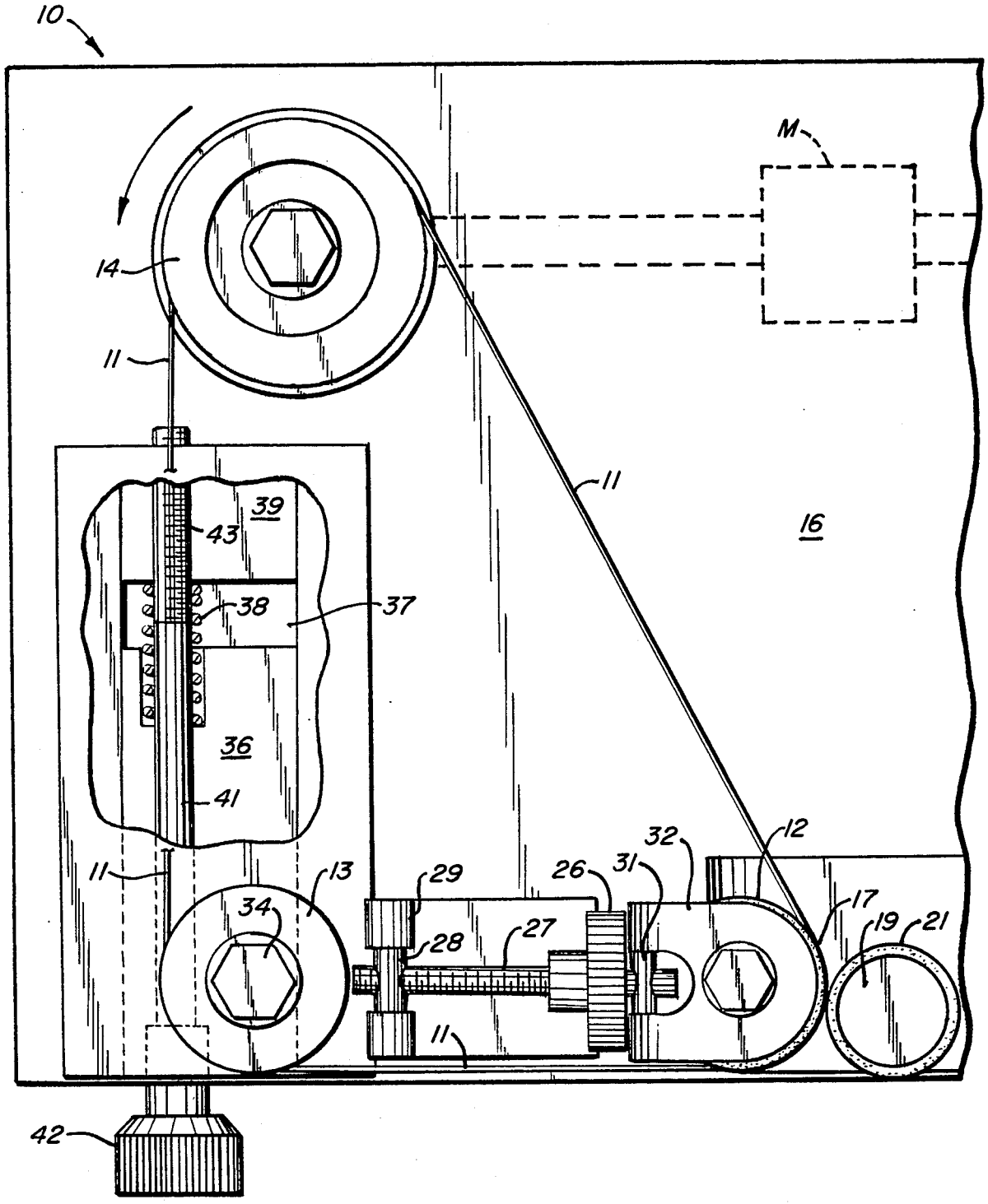
FIG. 3 is a plan view of the knife sharpening apparatus.
Figure 4:
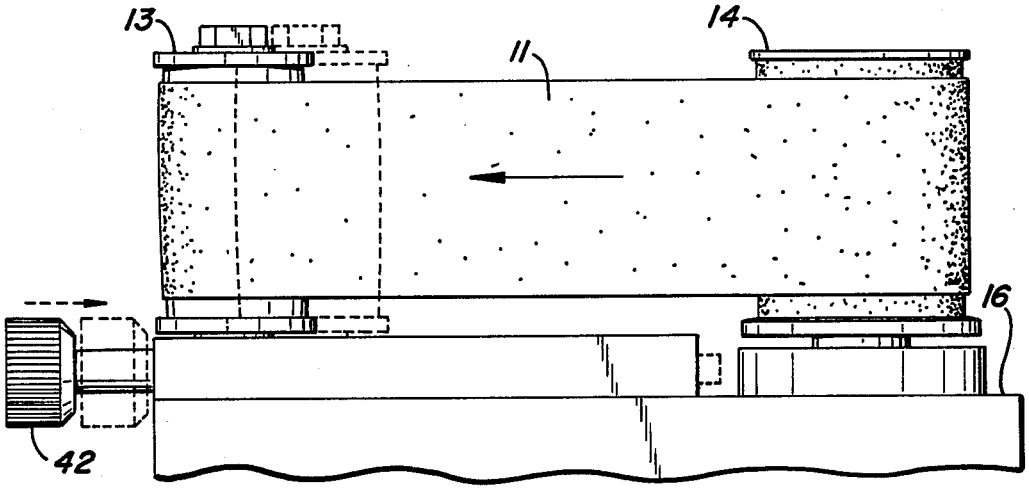
FIG. 4 is a side view of the knife sharpener.

As shown in FIG. 3, a suitable form of motor M, preferably under the base 16, is drivingly connected to one of the rollers for each belt 11, preferably the rear rollers 14 in the three-roller embodiment shown in the drawings. The driving connection is shown only schematically, and may be by belt, chain, gearing or other appropriate connection.

Figure 2:
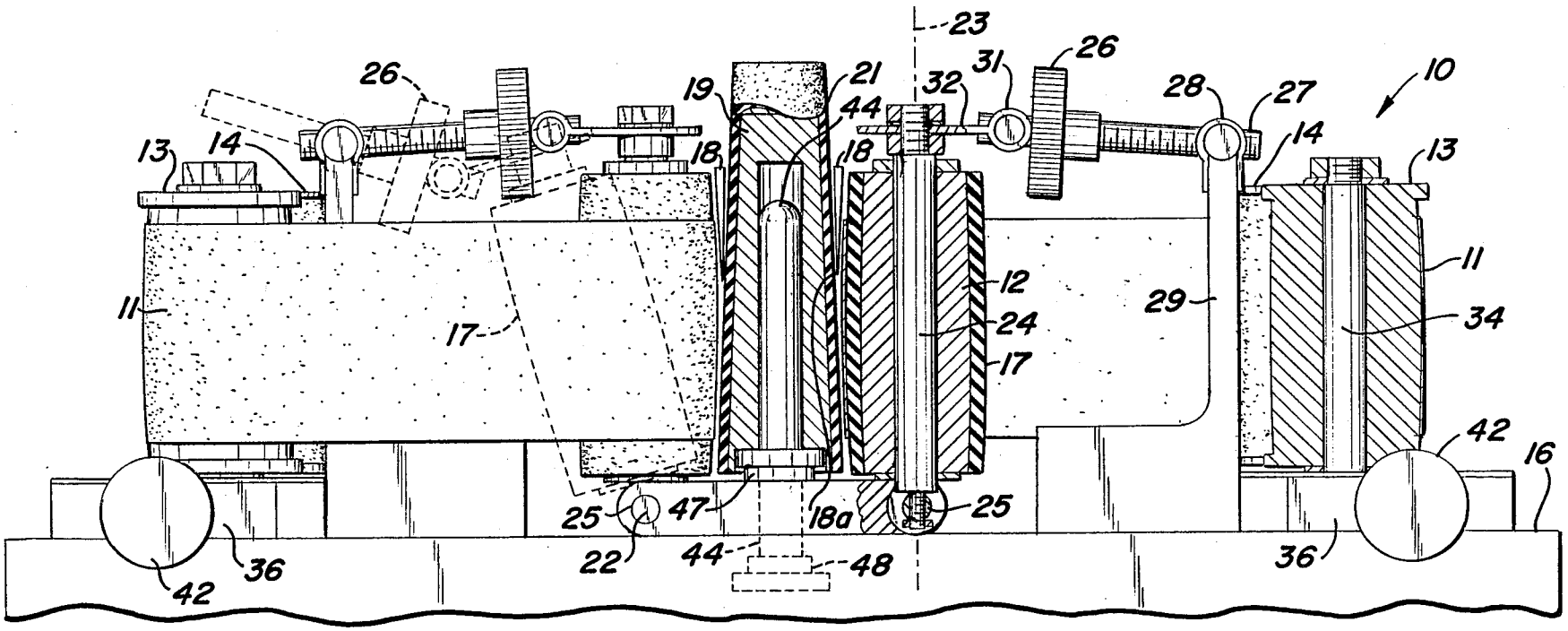
FIG. 2 is a front elevation view showing the knife sharpening apparatus.

As illustrated in FIG. 2, the rollers, particularly the support rollers 12, are crowned to avoid wearing out of the edges of the belt and to put maximum tension at the middle of the belt for best operation of the belt on the rollers. The support rollers 12 are also adjustment rollers, and are supported on the base for tilt adjustment about an axis 22 perpendicular to the axis of rotation 23 of the roller. Central shafts 24 of each support/adjustment roller 12 are mounted on a suitable rotational bearing 25 connected to the base 16, so that the rollers 12 are tiltable back toward one of the other two rollers supporting the belt, preferably the roller 13 as shown. The purpose of this tilt adjustment is to achieve proper belt alignment, and also to facilitate a quick changing of the belt or belts by tilting the roller back to a deep angle as indicated in the drawing.

A preferred mechanism for adjusting the tilt of the rollers 12 is shown in FIGS. 1, 2 and 3 of the drawing. The mechanism includes an adjustment wheel 26 on a rotatable shaft 27 which is threaded through a pivotable member 28, pivotable about a horizontal axis on an upright 29 secured to the base or frame 16. The other end of the shaft 27 is connected in a pivotal connection 31 to a flange 32 rigidly affixed to the upper end of the shaft 24 for the support roller 12. Thus, when the adjustment wheel 26 is turned, the threaded shaft 27 moves through the threaded pivotable member 28 to move the support roller 12 on its tilt axis 22 toward or away from the upright, belt-tight position shown in FIGS. 2 and 3. During this motion the threaded shaft 27 goes through changes in its angle of inclination, as indicated.

As shown in the figures, the left and right sides of the knife sharpener 10 may be similar, mirror images of each other.

The tilt adjustment just described in for achieving proper alignment of the grinding belts 11, and also provides for lowering the rollers 12 to a deep tilt angle as indicated in FIG. 2, for rapid changing of the belts when desired. Tension on the belts, however, preferably is controlled by the roller 13 in each belt assembly. The roller 13 is rotatable on a shaft 34 which is supported on a slideable block 36, slideable within a space 37 associated with the base structure 16. A compression spring 38 bears against the slideable block 36 and against fixed structure 39 to urge the block 36 and the roller 13 outwardly with a preselected force, keeping the grinding belt 11 at a preselected tension. A rotatable rod 41 with a handle 42 is threaded at 43 and threadedly connected into a bore in the fixed structure 39. In normal operation of the knife sharpener, the rod 41 is idle, neither in tension nor compression, with the spring 38 providing the only force acting to urge the roller 13 to tension the belt 11. When the belt 11 is to be changed, the operator normally tightens down the handle 42 and the rod 41, to move them inwardly and to draw the movable block 36 inwardly, against the force of the spring 38, to relax belt tension and enable the belt to be removed and replaced.

Figure 5:
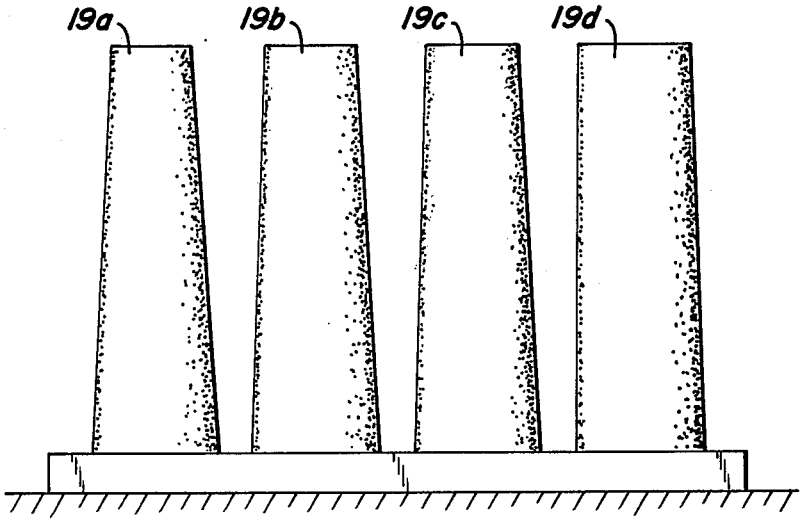
FIG. 5 is a view showing a series of guide rollers of different tapers for use interchangeably as a part of the knife sharpening apparatus.

The roller guide 19 is positioned over a shaft 44 which is mounted on bearings 47, 48 connected to the base structure 16. As shown in FIG. 5, there are provided a series of different guide rollers 19, for example four as shown, indicated by the reference numbers 19*a*, 19*b*, 19*c* and 19*d*. The guide rollers are of different tapers, and the operator selects the proper roller for the particular knife 18 he wishes to sharpen. For example, if the knife is of a large depth from its cutting edge to its upper, non-cutting edge, a more sharply tapered guide roller is selected, so that the operator can achieve the desired angle at which the cutting edge 18*a* meets the grinding belt 11. For knives of very small height, the guide roller 19 should be less tapered, closer to cylindrical, as, for example, the guide roller 19*d*. In any event, as mentioned above, the guide rollers are covered by a resilient rubber or synthetic sleeve 21 which does not contact the grinding belts 11, but comes in very close proximity to them.

The resilient sleeves 17 and 21, on the support rollers 12 and the guide rollers 19, are an important feature of the invention. It has been found to be very important that the belt 11, in the area where it is contacted by the knife blade to be sharpened, be backed up by a resilient cushion, to facilitate reliably achieving a smooth and sharp cutting edge. The resilient material 21 on the guide roller 19 provides the frictional engagement with the opposite side of the knife blade 18 as the knife blade is twisted to force it against the belt and pulled back toward the user. The bearing-mounted rotatable roller 19 acts to smoothly guide the knife blade 18 in its retracted movement during the sharpening operation.

It should be understood that, although the invention is shown with two mirror-image similar grinding belt assemblies, most of the objectives of the invention can be achieved with a single belt assembly, which is still within the scope of the invention. For example, a single belt assembly as shown on one side of FIGS. 2 and 3, with a cylindrical guide roller 19 closely spaced to the belt at the support roller 12, can be used effectively in sharpening a knife blade 18 by first pulling it through in an upright position as shown in FIG. 2, then again in an inverted position, with the cutting edge 18*a* upward.

It is also within the principles of the invention to have a single belt assembly as in one half of the embodiment shown in the drawings, but turned at right angles so that the rollers are horizontal, with the sharpening support roller 12 at the top. Knives can then be sharpened by laying them across the roller 12, perpendicular to the rotational axis of the roller (the belt still moving away from the user), and pulling the knife toward the user. The support roller includes the resilient sleeve 17, for aiding in the achieving of a good cutting edge, even without any guide roller.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A knife sharpener, comprising:

a base;

a pair of grinding belts and at least two rollers supporting each of the grinding belts, the rollers supported on the base for rotation about vertical axes;

motor means connected to the base and driving one of the rollers on each grinding belt such that the belts rotate in opposite directions;

one roller of each belt being a support roller for knife sharpening, the two support rollers being spaced apart with a guide roller between them, the guide roller being rotationally supported on the base on a vertical axis and closely adjacent to the grinding belt at each support roller to define a narrow crevice means on each side of the guide roller for receiving a knife blade in generally horizontal orientation perpendicular to the axes of rotation of the guide roller and the support roller and twisted about a longitudinal axis of the blade to engage an upper edge of the knife blade against the guide roller and force the cutting edge of the blade against the belt; and each support roller and the guide roller including resilient cushioning sleeve means for enabling local deformation of one support roller and the guide roller by a knife blade twisted therebetween, to permit a manually adjustable degree of twisting of the knife blade and to control the degree of twisting of the knife blade in the crevice so that the depth of grinding of the cutting edge is controlled by the amount of twisting force applied to the blade as the blade is pulled horizontally through the crevice.

2. The knife sharpener of claim 1, wherein the guide roller is tapered, increasing in diameter from top to bottom.

3. The knife sharpener of claim 2, including means for quick removal and replacement of the guide roller, and including a plurality of guide rollers of differing degrees of taper and diameter, selectable for use between the support rollers, for accommodating knife blades of different depths.

4. The knife sharpener of claim 1, further including belt loosening and tensioning means associated with a second roller of each belt, for normally maintaining tension in the belt with spring pressure, and for selectively moving said second roller linearly in a direction to loosen tension in the belt when desired for changing the belt.

5. The knife sharpener of claim 4, wherein said belt loosening and tensioning means comprises a mounting block supporting said second roller and linearly slideable with respect to the base, a compression spring engaged between the slideable mounting block and fixed structure of the base, and a threaded rod and adjustment head engaged with the movable mounting block and with the base so as to draw the mounting block in the direction of belt loosening when rotated.

* * * * *